United States Patent [19]

Muench

[11] Patent Number: 4,972,049

[45] Date of Patent: Nov. 20, 1990

[54] BUSHING AND GASKET ASSEMBLY

[75] Inventor: Frank F. Muench, Waukesha, Wis.

[73] Assignee: Cooper Power Systems, Inc., Houston, Tex.

[21] Appl. No.: 131,691

[22] Filed: Dec. 11, 1987

[51] Int. Cl.[5] ..... H01B 17/30

[52] U.S. Cl. ..... 174/152 R; 439/559; 439/921

[58] Field of Search ..... 174/18, 152 R, 153 R, 174/167, 31 R, 142, 143; 439/544, 550, 556, 559, 562, , 564, 921

[56] References Cited

U.S. PATENT DOCUMENTS

| | | | |
|---|---|---|---|
| 2,564,181 | 8/1951 | Van Ryan | 174/152 R |
| 2,941,182 | 6/1960 | Heller | 439/559 |
| 3,054,850 | 9/1962 | Dulude | 174/152 R X |
| 3,193,617 | 7/1965 | Deakin | 174/153 R |
| 3,200,366 | 8/1965 | Stuart | 174/153 R X |
| 3,784,733 | 1/1974 | Farmer et al. | 174/31 R X |
| 3,803,523 | 4/1974 | Farmer et al. | 174/152 R X |
| 4,573,757 | 3/1986 | Cochran et al. | 439/564 X |

*Primary Examiner*—Laramie E. Askin

*Attorney, Agent, or Firm*—Michael, Best & Friedrich

[57] ABSTRACT

An electrical apparatus comprising a container adapted to contain an electrical mechanism, the container including a wall having an outer surface and having therethrough a bore, a bushing including a contact adapted to be connected to the electrical mechanism, a portion extending through the bore, and a surface facing the outer surface of the wall and having therein an endless recess, the recess surrounding the portion and having a volume, an endless gasket located in the recess, surrounding the portion, and having a volume when the gasket is uncompressed that is less than the volume of the recess, and studs for securing the bushing to the container and for compressing the gasket between the bushing and the outer surface of the container.

27 Claims, 1 Drawing Sheet

BUSHING AND GASKET ASSEMBLY

BACKGROUND OF THE INVENTION

The invention relates to electrical bushing assemblies.

A known bushing assembly includes an elongated contact and an insulating shank molded around the contact. The shank includes integral flanges or ears which can be fastened to the tank of an electrical apparatus, such as an oil insulated transformer. Each flange or ear has therethrough an aperture, and the tank includes mounting studs extending through the apertures. Nuts are threaded onto the mounting studs to secure the bushing to the tank. A portion of the shank and the contact extend through a bore in the tank wall, and an annular gasket surrounds the shank portion between the bushing and the tank wall to seal the joint therebetween.

In some known bushing assemblies, the gasket is located in a complementary recess in the bushing, with the gasket completely filling the recess when the gasket is uncompressed. As the bushing is secured to the tank and the gasket is compressed, the gasket acts like a hydraulic fluid, concentrating stress on the molded insulating shank of the bushing. If this stress exceeds the material strength of the shank, the shank breaks.

A typical tank wall is not completely flat. Furthermore, the tank wall can bulge when the oil inside is heated by transformer losses, or can buckle as the oil cools. If the nuts are tightened down so that the ears are tightly mated with the tank wall, a change in the shape of the tank wall can fracture the bushing ears.

SUMMARY OF THE INVENTION

The invention provides an electrical apparatus, such as an oil insulated transformer, comprising a container for an electrical mechanism. The container includes a generally planar wall having an outer surface and having therethrough a generally circular bore. The outer wall has fixedly mounted thereon a plurality of mounting studs located adjacent and in surrounding relation to the bore.

The apparatus also comprises a bushing including a contact connected to the electrical mechanism. Preferably, the contact is elongated and extends through the bore in the container wall. The bushing also includes an insulating shank molded around the contact. The shank includes a portion surrounding the contact and extending through the bore, and a generally planar surface facing the outer surface of the container and having therein an annular recess surrounding the above-mentioned shank portion. In the preferred embodiment, the radially inner boundary of the recess is defined by the outer surface of the shank portion, and the radially outer boundary of the recess is defined by a radially outer surface that is opposed to and faces the outer surface of the shank portion. The shank also includes a plurality of ears or flange portions having therethrough respective apertures receiving respective mounting studs. The bushing further includes, on the planar surface, a plurality of projections located adjacent each of the apertures and engaging the outer surface of the container so that the bushing surface is spaced from the outer surface of the container. The force required to crush the projections is less than the force required to break the bushing ears.

The apparatus also comprises a generally annular gasket located in the recess and surrounding the shank portion. The gasket has a circular outer surface engaging the outer surface of the recess and a generally circular inner surface engaging the outer surface of the shank portion. The gasket is held in the recess by the engagement of the gasket with the walls of the recess. Furthermore, the gasket has a volume that is less than the volume of the recess. More particularly, in the preferred embodiment, the inner surface of the gasket has therein a plurality of recesses, so that the gasket forms a plurality of radially inwardly extending, finger-like portions engaging the outer surface of the shank portion.

This securely holds the gasket in place, eliminating problems with the present gasket and bushing design. Present designs of the bushing and gasket allow the gasket to either shift in its recess because the outer diameter of the inner portion of the bushing is less than the inner diameter of the gasket, or the gasket fills the recess completely, causing stress to the bushing when used across a presently used range of hole sizes.

The apparatus further comprises, on each of the mounting studs, a nut threaded onto the mounting stud for securing the bushing to the container and for compressing the gasket between the bushing and the outer surface of the container. When the nuts are tightened to force the bushing, i.e., the projections, against the container wall, the gasket is compressed. As explained above, the compressed gasket acts like a hydraulic fluid. However, because the gasket does not entirely fill the recess, the gasket can flow into the voids created by the recesses in the gasket instead of exerting stress on the shank. This assists in preventing breakage of the shank.

If the nuts are tightened too much, or if the container wall changes shape, the bushing projections will collapse before the bushing ears fracture. Thus, the bushing projections further reduce damage to the shank.

Other features and advantages of the invention will become apparent to those skilled in the art upon review of the following detailed description, claims and drawings.

Figure 1:
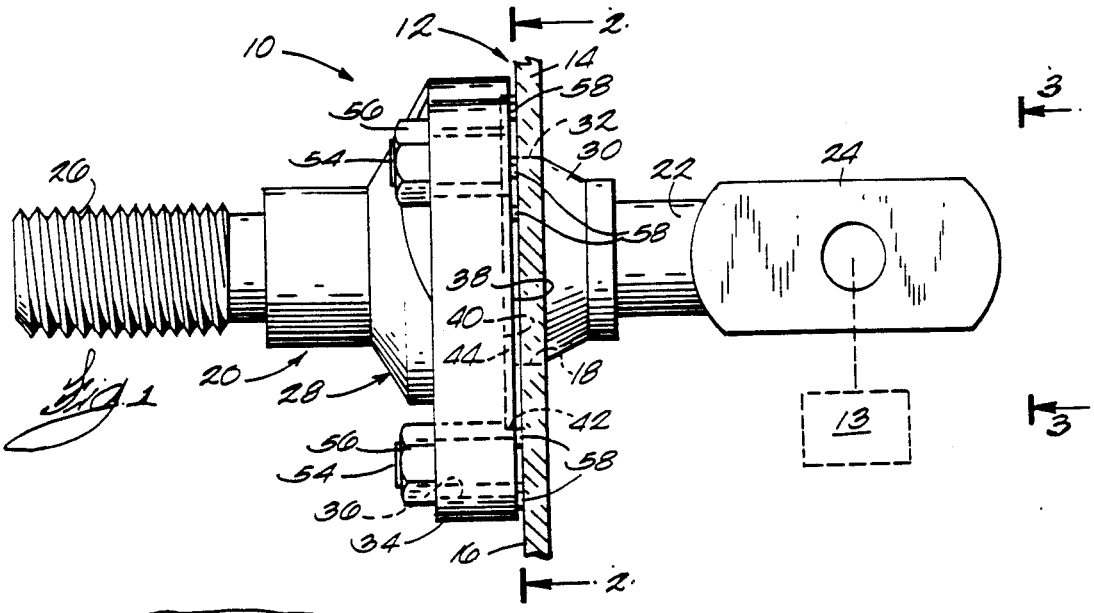
FIG. 1 is a side elevational view, partially in cross-section, of an electrical apparatus embodying the invention and including a gasket.
Figure 2:
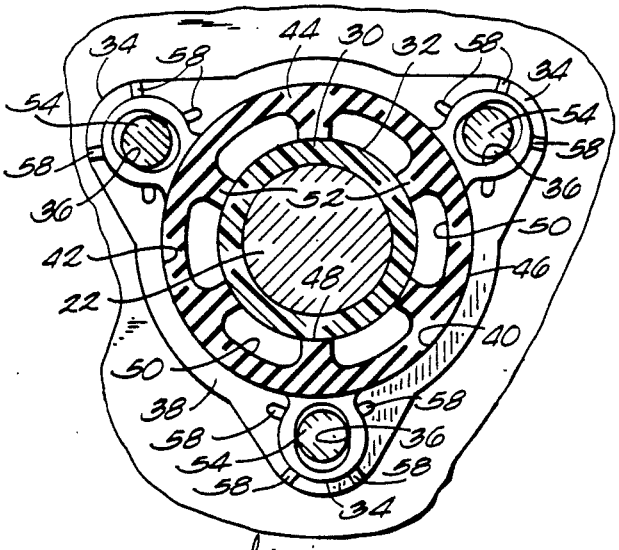
FIG. 2 is a view taken along line 2—2 in FIG. 1.
Figure 3:
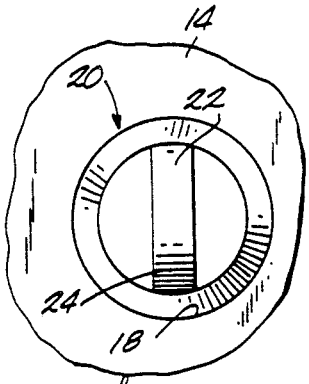
FIG. 3 is a view taken along line 3—3 in FIG. 1.
Figure 4:
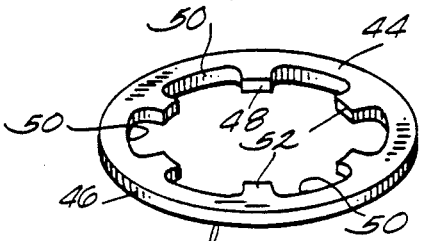
FIG. 4 is a perspective view of the gasket.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is an electrical apparatus 10, such as an oil insulated transformer, embodying the invention. As shown in FIG. 1, the apparatus 10 comprises a container 12 (partially shown) containing an electrical mechanism 13 (shown schematically). The container 12 includes a generally planar wall 14 having an outer surface 16 and having therethrough a circular bore 18.

The apparatus 10 also comprises a bushing 20 including an elongated contact 22 connected to the electrical mechanism 13. In the illustrated construction, the contact 22 extends through the container bore 18 and includes an inner end 24 located within the container 12 and connected to the mechanism 13, and a threaded outer end 26 located outside of the container 12. The bushing 20 also includes an insulating shank 28 molded around the contact 22 and made of a suitable material such as epoxy. The shank 28 includes an annular portion 30 which surrounds the contact 22 and extends through the container bore 18, and which includes a generally cylindrical outer surface 32. The shank 28 also includes three flange portions or ears 34 having therein respective apertures 36. The shank 28 also includes a generally planar surface 38 facing the outer surface 16 of the container 12 and having therein an endless recess 40 which surrounds the shank portion 30 and which has a volume. In the preferred embodiment, the recess 40 is annular and has a radially inner boundary defined by the outer surface 32 of the shank portion 30, and the shank 28 includes a generally cylindrical surface 42 opposed to and facing the outer surface 32 of the shank portion 30 and defining the radially outer boundary of the recess 40. Thus, the outer surface 32 of the shank portion 30 and the radially outer surface 42 constitute opposed, radially inner and outer surfaces partially defining the recess 40.

The apparatus 10 also comprises an endless gasket 44 located in the recess 40 and surrounding the shank portion 30. The gasket 44 is made of a suitable material such as rubber. In the preferred embodiment, the gasket 44 is generally annular and includes a circular outer surface 46 engaging the radially outer surface 42 of the bushing 20 and a generally circular inner surface 48 engaging the outer surface 32 of the shank portion 30. Because of the engagement of the gasket 44 with the inner and outer surfaces of the recess 40, the gasket 44 is retained in the recess 40 when the gasket 44 is uncompressed.

The gasket 44 has a volume, when the gasket 44 is uncompressed, that is less than the volume of the recess 40. More particularly, the inner surface 48 of the gasket 44 has a shape that is different from the shape of the outer surface 32 of the shank portion 30. Still more particularly, in the preferred embodiment, the inner surface 48 of the gasket 44 has therein a plurality of recesses 50. Accordingly, the gasket 44 forms a plurality of radially inwardly extending, finger-like portions 52 engaging the outer surface 32 of the shank portion 30 Because the volume of the gasket 44 is less than the volume of the recess 40, the gasket 44, when compressed, flows into the voids defined by the recesses 50 rather than exerting stress on the bushing 20.

The apparatus 10 further comprises means for securing the bushing 20 to the container 12 and for compressing the gasket 44 between the bushing 20 and the outer surface 16 of the container 12. While various suitable securing and compressing means can be employed, in the preferred embodiment, such means includes means for securing the flange portions or ears 34 of the bushing 20 to the container 12. While various suitable means can be used for securing the flange portions 34 to the container 12, in the illustrated construction, such means includes, for each of the apertures 36, a respective externally threaded stud or member 54 fixedly mounted on the container wall and extending through the aperture 36. The securing means further includes a nut 56 threaded onto each stud 54 so that the associated flange portion 34 is captured between the nut 56 and the outer surface 16 of the container 20.

The apparatus 10 further comprises deformable means for resisting fracturing of the flange portions 34. While various suitable deformable means can be employed, in the preferred embodiment, such means includes, on the bushing surface 38, a plurality of projections 58 located adjacent each of the apertures 36 and engaging the outer surface 16 of the container 12 so that the bushing surface 38 is spaced from the outer surface 16 of the container 12. The force required to crush the projections 58 is less than the force required to break the flange portions 34. Alternatively stated, the compression strength of the projections 58 on each flange portion 34 is less than the cantilever strength of that flange portion 34. Accordingly, the projections 58 will deform or be crushed before the flange portions 34 will fracture.

It is noted that the compression strength of a projection 58 is a function of the area of the projection 58 in contact with the container surface 16. More particularly, the greater the area of a projection 58, the greater its compression strength. Thus, the overall compression strength of the projections 58 on a flange portion 34 can be varied, and can be made less than the cantilever strength of the flange portion 34, by varying the area of the projections 58. In the preferred embodiment, each flange portion 34 has thereon four projections 58, and each projection 58 has dimensions of approximately $0.08 \times 0.125$ inch (area = 0.01 square inch), with a thickness of approximately 0.02 inch.

Various features of the invention are set forth in the following claims.

I claim:

1. An electrical apparatus comprising a container adapted to contain an electrical mechanism, said container including a wall having an outer surface and having therethrough a bore, a bushing including a contact adapted to be connected to the electrical mechanism, a portion extending through said bore, and a surface facing said outer surface of said wall and having therein an endless recess, said recess surrounding said portion and having a volume and a depth, and said bushing also including opposed, radially inner and outer surfaces partially defining said recess, an endless gasket located in said recess, surrounding said portion, engaging said inner and outer surfaces when said gasket is uncompressed, having a thickness when said gasket is uncompressed that is greater than said dépth of said recess, and having a volume when said gasket is uncompressed that is less than said volume of said recess, and means for securing said bushing to said container and for compressing said gasket between said bushing and said outer surface of said container.

2. An apparatus as set forth in claim 1 wherein said portion of said bushing has an outer surface, and wherein said radially inner surface is said outer surface of said portion.

3. An apparatus as set forth in claim 1 wherein said radially inner surface has a shape, and wherein said gasket has a radially inner surface engaging said radially inner surface of said bushing and having a shape that is different from said shape of said radially inner surface of s id bushing.

4. An apparatus as set forth in claim 1 wherein said recess is annular, and wherein said gasket is generally annular and includes a circular outer surface, and a generally circular inner surface having therein a plurality of recesses.

5. An apparatus as set forth in claim 1 wherein said bushing includes a flange portion having therethrough an aperture, and wherein said securing and compressing means secures said flange portion to said container.

6. An apparatus as set forth in claim 5 wherein said securing and compressing means includes a member extending through said aperture.

7. An apparatus as set forth in claim 6 wherein said member is an externally threaded stud fixedly mounted on said wall, and wherein said securing and compressing means also includes a nut threaded onto said stud so that said flange portion is captured between said nut and said wall.

8. An apparatus as set forth in claim 5 and further comprising deformable means operably connected to said flange portion for resisting fracturing of said flange portion.

9. An apparatus as set forth in claim 8 wherein said deformable means includes, on said bushing surface, a plurality of projections located adjacent said aperture and engaging said outer surface of said container so that said bushing surface is spaced from said outer surface of said container, and wherein the force required to crush said projections is less than the force required to break said flange portion.

10. A bushing and gasket assembly adapted to be mounted on a container containing an electrical mechanism, the container including a wall having an outer surface and having therethrough a bore, said assembly comprising a bushing including a contact adapted to be connected to the electrical mechanism, a portion adapted to extend through the bore, and a surface adapted to face the outer surface of the wall and having therein an endless recess, said recess surrounding said portion and having a volume, said bushing also including opposed, radially inner and outer surfaces partially defining said recess, said radially inner surface having a shape, and said assembly also comprising an endless gasket located in said recess, surrounding said portion, engaging said inner and outer surfaces when said gasket is uncompressed, having a volume when said gasket is uncompressed that is less than said volume of said recess, and having a radially inner surface which engages said radially inner surface of said bushing and which has a shape that is different from said shape of said radially inner surface of said bushing.

11. An electrical apparatus comprising a container adapted to contain an electrical mechanism, said container including a wall having an outer surface and having therethrough a bore, a bushing including a contact adapted to be connected to the electrical mechanism, a portion extending through said bore, and a flange portion, means for securing said bushing to said container and including means for securing said flange portion to said container, and deformable means operably connected to said flange portion for resisting fracturing of said flange portion.

12. An apparatus as set forth in claim 11 wherein said flange portion has therethrough an aperture and includes a surface facing said outer surface of said container, wherein said securing means includes a member extending through said aperture, and wherein said deformable means includes, on said flange portion surface, a plurality of projections located adjacent said aperture and engaging said outer surface of said container so that said flange portion surface is spaced form said outer surface of said container, the force required to crush said projections being less than the force required to break said flange portion.

13. An apparatus as set forth in claim 12 wherein said member is an externally threaded stud fixedly mounted on said wall, and wherein said securing means further includes a nut threaded onto said stud so that said flange portion is captured between said nut and said outer surface of said container.

14. An apparatus as set forth in claim 11 and further comprising an endless gasket surrounding said bushing portion and located between said bushing and said outer surface of said container, and wherein said securing means compresses said gasket between said bushing and said outer surface of said container.

15. A bushing and gasket assembly adapted to be mounted on a container containing an electrical mechanism, the container including a wall having an outer surface and having therethrough a bore, said assembly comprising a bushing including a contact adapted to be connected to the electrical mechanism, a portion adapted to extend through the bore, and a surface adapted to face the outer surface of the wall and having therein an endless recess, said recess surrounding said portion and having a volume and a depth, and said bushing also including opposed, radially inner and outer surfaces partially defining said recess, and said assembly also comprising an endless gasket located in said recess, surrounding said portion, engaging said inner and outer surfaces when said gasket is uncompressed, having a thickness when said gasket is uncompressed that is greater than said depth of said recess, and having a volume when said gasket is uncompressed that is less than said volume of said recess.

16. An assembly as set forth in claim 15 wherein said portion of said bushing has an outer surface, and wherein said radially inner surface is said outer surface of said portion.

17. An assembly as set forth in claim 15 wherein said radially inner surface has a shape, and wherein said gasket has a radially inner surface engaging said radially inner surface of said bushing and having a shape that is different from said shape of said radially inner surface of said bushing.

18. An assembly as set forth in claim 15 wherein said recess is annular, and wherein said gasket is generally annular and includes a circular outer surface, and a generally circular inner surface having therein a plurality of recesses.

19. An assembly as set forth in claim 15 wherein said bushing includes a flange portion having therethrough an aperture adapted to receive a mounting stud on the container.

20. An assembly as set forth in claim 19 and further comprising deformable means operably connected to said flange portion for resisting fracturing of said flange portion.

21. An assembly as set forth in claim 20 wherein said deformable means includes, on said bushing surface, a plurality of projections located adjacent said aperture and for engaging the outer surface of the container so that said bushing surface is spaced from the outer surface of the container when mounted thereon, and wherein the force required to crush said projections is less than the force required to break said flange portion.

22. A bushing and gasket assembly adapted to be mounted on a container containing an electrical mechanism, the container including a wall having an outer surface and having therethrough a bore, said assembly comprising a bushing including a contact adapted to be connected to the electrical mechanism, a portion adapted to extend through the bore, and a surface adapted to face the outer surface of the wall and having therein an annular endless recess, said recess surrounding said portion and having a volume, and said assembly also comprising a generally annular endless gasket located in said recess, surrounding said portion, and having a volume when said gasket is uncompressed that is less than said volume of said recess, and said gasket including a circular outer surface, and a generally circular inner surface having therein a plurality of recesses.

23. A bushing adapted to be mounted on a container containing an electrical mechanism, the container including a wall having an outer surface and having therethrough a bore, said bushing comprising a contact adapted to be connected to the electrical mechanism, a portion adapted to extend through the bore, and a flange portion having therethrough an aperture adapted to receive a mounting stud on the container, and deformable means operably connected to said flange portion for resisting fracturing of said flange portion.

24. A bushing as set forth in claim 23 wherein said portion includes a surface adapted to face the outer surface of the container, and wherein said deformable means includes, on said surface, a plurality of projections located adjacent said aperture and adapted to engage the outer surface of the container so that said flange portion surface is spaced from the outer surface of the container, the force required to crush said projections being less than the force required to break said flange portion.

25. A bushing as set forth in claim 23 and further comprising an endless gasket surrounding said bushing portion and adapted to be located between said bushing and the outer surface of the container.

26. A bushing and gasket assembly adapted to be mounted on a container containing an electrical mechanism, the container including a wall having an outer surface and having therethrough a bore, said assembly comprising a bushing including a contact adapted to be connected to the electrical mechanism, a portion adapted to extend through the bore, and a surface adapted to face the outer surface of the wall and having therein an endless recess surrounding said portion, said bushing also including a radially inner surface partially defining said recess, said radially inner surface having a shape, and said assembly also comprising an endless gasket located in said recess, surrounding said portion, and having a radially inner surface which engages said radially inner surface of said bushing and which has a shape that is different from said shape of said radially inner surface of said bushing.

27. A bushing and gasket assembly adapted to be mounted on a container containing an electrical mechanism, the container including a wall having an outer surface and having therethrough a bore, said assembly comprising a bushing including a contact adapted to be connected to the electrical mechanism, a portion adapted to extend through the bore, and a surface adapted to face the outer surface of the wall and having therein an annular endless recess surrounding said portion, and said assembly also comprising a generally annular endless gasket located in said recess, surrounding said portion, and including a generally circular inner surface having therein a plurality of recesses.

* * * * *